US006679949B2

(12) United States Patent
De Almeida

(10) Patent No.: US 6,679,949 B2
(45) Date of Patent: Jan. 20, 2004

(54) METHOD AND DEVICE TO ALLOW A RIGID PIG TO PASS INTO A FLOW PIPE WHICH REQUIRES THE USE OF A HOLLOW FLOW-CONSTRICTING DEVICE

(75) Inventor: Alcino Resende De Almeida, Rio de Janeiro (BR)

(73) Assignee: Petroleo Brasileiro S.A., Petrobras (BR)

( * ) Notice: Subject to any disclaimer, the term of this patent is extended or adjusted under 35 U.S.C. 154(b) by 164 days.

(21) Appl. No.: 10/041,618

(22) Filed: Jan. 10, 2002

(65) Prior Publication Data

US 2002/0117186 A1 Aug. 29, 2002

(30) Foreign Application Priority Data

Feb. 28, 2001 (GB) ..... 0105009

(51) Int. Cl.[7] ..... B08B 9/04

(52) U.S. Cl. ..... 134/8; 134/22.11; 134/22.12; 15/3.5; 15/3.51; 137/115.01; 137/115.05

(58) Field of Search ..... 134/8, 18, 22.1, 134/22.11, 22.12; 15/3.5, 3.51; 137/7, 9, 109, 115.01, 115.04, 115.05, 242, 244, 245

(56) References Cited

U.S. PATENT DOCUMENTS

| | | | | | |
|---|---|---|---|---|---|
| 3,983,895 | A | | 10/1976 | Pouska et al. | |
| 4,135,949 | A | * | 1/1979 | Reese | 134/18 |
| 4,314,577 | A | * | 2/1982 | Brister | 137/13 |
| 4,574,830 | A | * | 3/1986 | Rickey et al. | 137/242 |
| 4,989,631 | A | | 2/1991 | Harbin | |
| 5,890,531 | A | | 4/1999 | Gairns | |
| 5,927,901 | A | * | 7/1999 | Graves | 405/158 |
| 5,980,645 | A | | 11/1999 | Price | |
| 6,041,803 | A | | 3/2000 | De Almeida et al. | |
| 6,336,238 | B1 | | 1/2002 | Tarlton | |
| 6,533,032 | B1 | * | 3/2003 | Seixas et al. | 166/70 |
| 6,569,255 | B2 | * | 5/2003 | Sivacoe | 134/8 |

FOREIGN PATENT DOCUMENTS

| | | |
|---|---|---|
| GB | 1179978 | 2/1970 |
| GB | 2196716 A | 5/1988 |
| GB | 2341695 A | 3/2000 |

* cited by examiner

*Primary Examiner*—Randy Gulakowski
*Assistant Examiner*—Saeed Chaudhry
(74) *Attorney, Agent, or Firm*—Nixon & Vanderhye PC

(57) ABSTRACT

There is disclosed a method and a device to allow a "rigid" pig to pass into an undersea flow pipe in which a hollow flow-constricting device is in use. According to the invention the device is provided with a first pipe branch and a second pipe branch. The first pipe branch is provided with a hollow flow-constricting device in it and both first and second pipe branches are provided with shut-off valves, whereby the flow can be diverted to the second pipe branch thereby enabling a rigid pig to pass into such second pipe branch, when necessary.

11 Claims, 3 Drawing Sheets

METHOD AND DEVICE TO ALLOW A RIGID PIG TO PASS INTO A FLOW PIPE WHICH REQUIRES THE USE OF A HOLLOW FLOW-CONSTRICTING DEVICE

FIELD OF THE INVENTION

The present invention relates to a method and a device to allow a rigid pig to pass into a flow pipe which requires the use of a hollow flow-constricting device. The proposed method and device are particularly suited to be used in an undersea flow pipe.

STATE OF THE ART

Pipes are widely used in the industry to transport diverse kinds of fluids. Such fluids may comprise a single constituent or multiple constituents, they may comprise a single phase or multiple phases, they may be highly compressible or they may be almost incompressible. Such pipes may be provided with varying internal diameters and configurations. In the oil industry the pipes, or flow pipes as they are usually referred to, are used to promote the flow of fluids from oil producing wells to gathering centres where the fluids are processed.

When an undersea oil field is commercially exploited, it is necessary for the production from the oil producing wells to flow through pipes to a production unit located at the surface. An undersea flow pipe is usually connected at one end to an oil producing well and extends along the sea bed to be connected at its other end to an undersea flow riser, which carries the fluids to the production unit at the surface.

Situations may occur in which it is necessary to insert into the undersea flow pipe at a certain location a hollow flow-constricting device which constricts the flow at that location. Such device can be, for example, a body externally shaped to match the inside portion of the undersea flow pipe where it is to be located, and have an orifice of any shape extending longitudinally therethrough so as to provoke a constriction in the flow.

The object of the insertion of such a device into the undersea flow pipe may be, for example, (a) to introduce a constriction in the flow to control the features of this flow, or (b) to introduce an element intended to be used in flow rate measuring operations, or (c) to control the phenomenon known as severe slugging which may occur in production systems provided with descending flow pipes followed by flow risers.

The severe slugging phenomenon is characterised by intense oscillations in the pressure and flow rate levels occurring in a multiphase flow having a gaseous phase. The severe slugging phenomenon causes difficulties in undersea production activities, which can seriously impair or even shut the oil production down.

The patent application GB 2 341 695, commonly owned by the applicants of the present patent application, discloses a device used to control the severe slugging phenomenon. A hollow flow-constricting device, preferably a venturi, is installed into a descending undersea flow pipe relatively close to the junction to a flow riser.

The design of a new undersea flow pipe may anticipate the need of such hollow flow-constricting device, which can be installed during the deployment of the undersea flow pipe. In existing undersea flow pipes, where access to the interior of the undersea flow pipe is easy and the oil production flow can be interrupted, the hollow flow-constricting device can be installed after cutting the undersea flow pipe, the integrity of the undersea flow pipe being reinstated by using any of the known pipe assembling techniques, e.g., welding.

However, besides causing ceasing of profits, shutting down of the production can cause many operational problems, especially in undersea flow pipes under the effects of low temperatures of the sea bed. Many of these undersea flow pipes are located at great sea depths, hindering the access by divers. A cutting operation in such an undersea flow pipe would be very difficult to be implemented, as it involves the retrieval of the undersea flow pipe from the seabed, or carrying out the operation using a remote operated vehicle, both being extremely expensive, time consuming and complex operations.

Thus, there is a need to provide a way of installing in an undersea flow pipe a hollow flow constricting device such as is described in GB 2 341 695, without causing the above drawbacks.

The British patent application 0102331.6, of Jan. 30, 2001, commonly owned by the applicants of the present patent application, discloses a method of setting a hollow flow-constricting device into a submarine flow pipe using flexible rigid pig, preferably foam rigid pig formed from polymeric foam which may be radially compressed when passing though a constriction. The word "pig" is used here to denote devices which are inserted into a pipe and which are urged by the flow flowing into that pipe, usually to clean the interior of the pipe.

Situations may occur in which it is needed for any reason to carry out an operation of passing into the undersea flow pipe a rigid pig which is not entirely compressible. For example, it is usual to pass a rigid pig into a flow pipe for inspecting its internal walls. Such a rigid pig includes a number of rigid bodies encasing inspecting equipment, said bodies being longitudinally connected between them by means of flexible unions, whereby the rigid pig is relatively longitudinally flexible, in order to pass through the curves of the flow pipe.

Usually such bodies, or most of them, are provided with external packing elements which are radially mounted to the bodies. Said packing elements are able to be compressed between the internal walls of the flow pipe and the external walls of its respective body, thereby forming a seal. Therefore, this kind of rigid pig is able to be partially radially compressed, but only to the radial extent of the packing elements. In other words, as the bodies are radially rigid, such a rigid pig may be partially longitudinally curved, but it is unable to be substantially radially compressed.

Therefore, such a radially rigid pig is not able to pass through the hollow flow-constricting device, which would preclude the above pig operation from occurring.

It should be mentioned that the retrieval of such a hollow flow-constricting device before each pigging operation although feasible is much too expensive and is not recommended.

The present invention proposes a novel device and method which overcome the above mentioned drawbacks, and can enable a rigid pig (as hereinafter defined) to be passed into an undersea pipe in which such a hollow flow-constricting device is used.

SUMMARY OF THE INVENTION

The present invention relates to a device and a method to allow a pig to pass into a flow pipe which requires the use of a hollow flow-constricting device.

In a first aspect the present invention encompasses a device to allow a pig to pass into a flow pipe in which a hollow flow-constricting device is in use, said device comprising:

a first pipe branch, provided with an upstream end and a downstream end;

a second pipe branch, provided with an upstream end and a downstream end;

a hollow flow-constricting device installed in the first pipe branch;

a first shut-off valve, installed in the first pipe branch;

a clear-flow second shut-off valve, installed in the second pipe branch;

a grating device, installed at the upstream ends of the first pipe branch and the second pipe branch to prevent the rigid pig from entering the first pipe branch, and wherein:

the upstream ends of the first and second pipe branches are interconnected at an upstream junction which is provided with an upstream connection; and the downstream ends of the first and second pipe branches are interconnected at a downstream junction which is provided with a downstream connection.

In a second aspect the present invention comprises a method of using the device of the first aspect to allow a pig to pass into a flow pipe in which a hollow flow-constricting device is in use, said method comprising the steps of— initially opening the clear-flow second shut-off valve, which is kept closed under normal operational conditions, whereby the flow is led to pass also into the second pipe branch;

next closing the first shut-off valve, which is kept open, under normal operational conditions, thereby blocking off the flow from passing into the first pipe branch, whereby the flow is led then to pass only into the second pipe branch;

next inserting a pig into a mechanism suited for such operation, located at any region of the upstream flow pipe segment;

allowing the pig to travel along the upstream flow pipe segment, urged by the flow, to pass into the upstream connection, next to travel along the second pipe branch to pass through the clear-flow second shut-off valve, and then to pass into the downstream connection and to keep on travelling along the downstream segment of the flow pipe;

then opening the first shut-off valve, after the pig has passed the downstream connection; and next closing the clear-flow second shut-off valve, thereby reinstating the normal operational conditions.

BRIEF DESCRIPTION OF THE DRAWINGS

Merely for illustration, the invention will be now described in more detail, together with the accompanying drawings in which.

DETAILED DESCRIPTION OF THE INVENTION

In the context of the present specification a pig which is substantially radially rigid is herein referred to as a "rigid pig".

As previously mentioned, there are situations in which it is needed to install a hollow flow constricting device into an undersea flow pipe, for example to prevent severe slugging from occurring. However, if it would also be needed to pass a rigid pig (as hereinbefore defined) into such undersea flow pipe, the hollow flow-constricting device would make such an operation difficult or even impossible.

The present invention provides a device and a method to overcome such problem, which allow the undersea flow pipe to normally operate with a hollow flow-constricting device into it.

Figure 1:
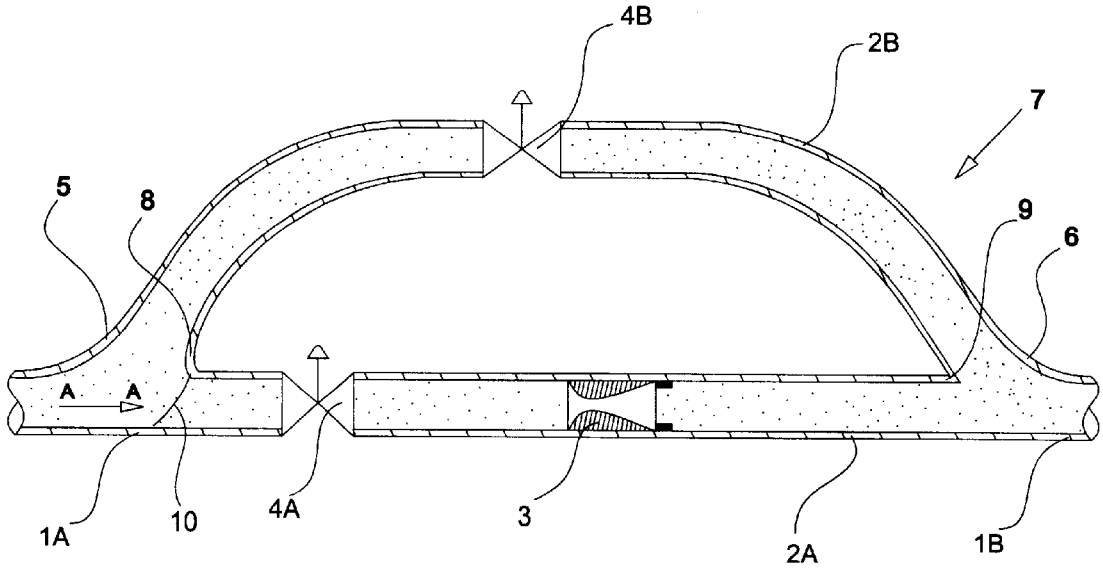
FIG. 1 is a longitudinal cross sectional view depicting an undersea flow pipe connected to a device according to a first embodiment of the present invention.

In FIG. 1 there is depicted a first embodiment of the device to allow a rigid pig to pass into a flow pipe which requires the use of a hollow flow constricting device, indicated by the numeral reference 7 and connected to an undersea flow pipe 1. A fluid flow A—A flows into the undersea flow pipe 1, in the direction indicated by the arrow in the FIG. 1.

For purposes of simplification of the description, the device to allow a "rigid" pig to pass into a flow pipe in which such a hollow flow-constricting device is in use will be hereafter referred to as "a device for the passage of a rigid pig".

In FIG. 1 the undersea flow pipe 1 is depicted with its upstream and downstream segments 1A and 1B respectively connected to upstream and downstream connections of the device 7 for the passage of a rigid pig, as will be described below in more detail.

The device 7 for the passage of a rigid pig depicted in FIG. 1 is connected, at its upstream and downstream connections 5 and 6, to the upstream and downstream segments 1A and 1B respectively, of the undersea flow pipe and comprises the following components:

a first pipe branch 2A, provided with an upstream end and a downstream end;

a second pipe branch 2B, provided with an upstream end and a downstream end;

a hollow flow-constricting device 3, installed in the first pipe branch 2A;

a first shut-off valve 4A, installed in the first pipe branch 2A;

a grating device 10, installed at the interconnection of the upstream ends of the first branch of pipe 2A and the second branch of pipe 2B, to guide a rigid pig away from the first pipe branch 2A and into the first second branch of pipe 2B; and a clear-flow second shut-off valve 4B, installed into the second pipe branch 2B;

wherein:

the upstream ends of the first and second pipe branches 2A and 2B are interconnected at an upstream junction 8 which is provided with an upstream connection 5;

the downstream ends of the first and second pipe branches 2A and 2B are interconnected at a downstream junction 9 which is provided with a downstream connection 6;

the upstream connection 5 is connected to an upstream segment 1A of the undersea flow pipe 1; and the downstream connection 6 is connected to a downstream segment 1B of the undersea flow pipe 1.

The first and second pipe branches 2A and 2B, respectively, are preferably provided with a cross section which is substantially equal to the cross section of the upstream and downstream segments 1A and 1B, respectively, of the undersea flow pipe. However, the cross section of the first and second pipe branches 2A and 2B can be larger than or smaller than the cross section of the upstream and downstream segments of undersea flow pipe 1A and 1B, and they can even be different between each other.

In the embodiment of the FIG. 1 the first branch of pipe 2A is substantially in alignment with the upstream and downstream undersea flow pipe segments 1A and 1B.

The first shut-off valve 4A may be installed in the first pipe branch upstream or downstream of the hollow flow-constricting device 3. In FIG. 1, merely for purposes of illustration, the first shut-off valve 4A is installed in the first pipe branch upstream of the hollow flow-constricting device 3. The clear-flow second shut-off valve 4B may be installed at any region of the second pipe branch 2B.

In the embodiment of FIG. 1 the first shut-off valve 4A is kept open and the clear-flow second shut-off valve 4B is kept closed in the normal operational conditions, whereby the flow A—A is led to pass through the hollow flow-constricting device 3.

When it is necessary to pass a pig into the undersea flow pipe 1 it suffices to open the clear-flow second shut-off valve 4B and to close the first shut-off valve 4A, as will be seen below in more detail, whereby the flow A—A is led to pass only into the second pipe branch 2B.

The grating device 10 acts as a guide to ensure displacement of the pig towards the second pipe branch 2B and to prevent the pig from being fortuitously entrapped into the first of pipe branch 2A.

The connection of the upstream and downstream undersea flow pipe segments 1A and 1B with the upstream and downstream connections 5 and 6, respectively, of the device for the passage of a rigid pig, must provide a smooth curved path for the passage of the pig, so as to preclude the pig from being jammed in said connections.

Figure 2:
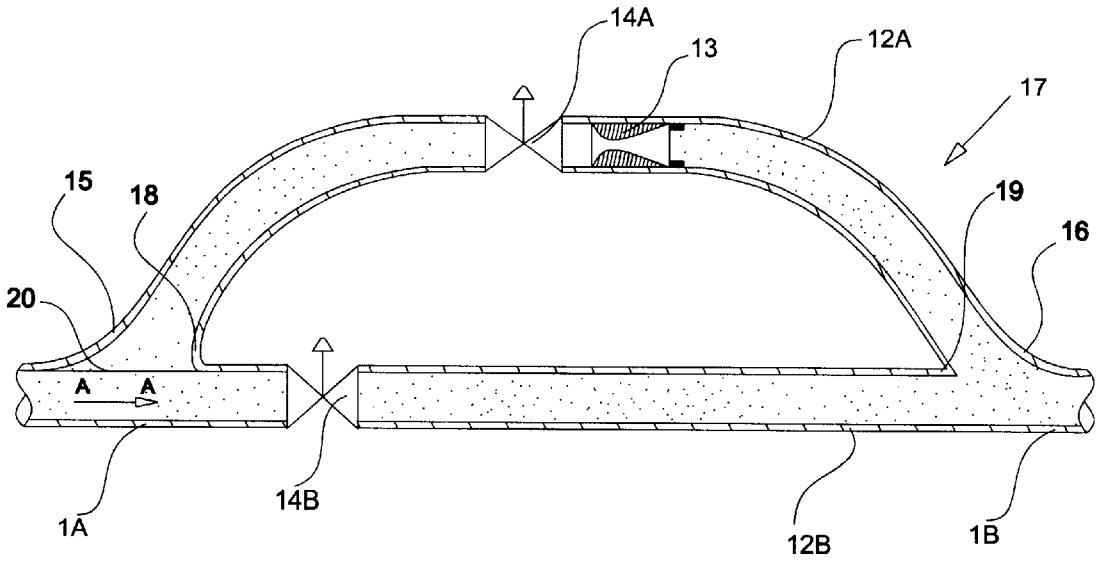
FIG. 2 is a longitudinal cross sectional view depicting an undersea flow pipe connected to a device according to a second embodiment of the present invention.

In FIG. 2 there is depicted a second embodiment of the device for the passage of a "rigid" pig, indicated by the numeral reference 17 and connected to an undersea flow pipe 1. A fluid flow A—A flows into the undersea flow pipe 1, in the direction indicated by the arrow in the FIG. 2.

In FIG. 2 the undersea flow pipe 1 is depicted with its upstream and downstream segments 1A and 1B respectively connected to upstream and downstream connections of the device 17 for the passage of a rigid pig, as will be seen below in more detail.

The device 17 for the passage of a rigid pig, depicted in FIG. 2, is connected to upstream and downstream undersea flow pipe segments 1A and 1B at its upstream and downstream connections 15 and 16, respectively, and comprises the following components:

- a first pipe branch 12A, provided with an upstream end and a downstream end;
- a second pipe branch 12B, provided with an upstream end and a downstream end;
- a hollow flow-constricting device 13, installed in the first pipe branch 12A;
- a first shut-off valve 14A, installed in the first pipe branch 12A;
- a grating device 20, installed in the first pipe branch 12A, at the interconnection of the upstream ends of the first pipe branch 12A and the second pipe branch 12B, to guide a rigid pig away from the first pipe branch 12A and into the second pipe branch 12B; and
- a clear-flow second shut-off valve 14B, installed in the second pipe branch 12B;

wherein:

- the upstream ends of the first and second pipe branches 12A and 12B are interconnected at an upstream junction 18 which is provided with an upstream connection 15;
- the downstream ends of the first and second pipe branches 12A and 12B are interconnected at a downstream junction 19 which is provided with a downstream connection 16;
- the upstream connection 15 is connected to an upstream undersea flow pipe segment 1A; and
- the downstream connection 16 is connected to a downstream undersea flow pipe segment 1B.

The first and second branches of pipe 12A and 12B, respectively, are preferably provided with a cross section which is substantially equal to the cross section of the upstream and downstream undersea flow pipe segments 1A and 1B, respectively. However, the cross section of the first and second pipe branches 12A and 12B can be larger than or smaller than the cross section of the upstream and downstream segments of undersea flow pipe 1A and 1B, and they can even be different from each other.

In the embodiment of the FIG. 2 the second pipe branch 12B is substantially in alignment with the upstream and downstream undersea flow pipe segments 1A and 1B.

The first shut-off valve 14A may be installed in the first pipe branch either upstream of or downstream of the hollow flow-constricting device 13. In FIG. 2, merely for purposes of illustration, the first shut-off valve 14A is installed in the first pipe branch upstream of the hollow flow-constricting device 13. The clear-flow second shut-off valve 14B may be installed at any region of the second pipe branch 12B.

In the embodiment of FIG. 2 the first shut-off valve 14A is kept open and the clear-flow second shut-off valve 14B is kept closed under normal operational conditions, whereby the flow A—A is led to pass through the hollow flow-constricting device 13.

When it is necessary to pass a "rigid" pig into the undersea flow pipe 1 it suffices to open the clear-flow second shut-off valve 14B and to close the first shutoff valve 14A, as will be seen below in more detail, whereby the flow A—A is led to pass only into the second pipe branch 12B.

The grating device 20 acts as a guide to ensure displacement of the pig towards the second pipe branch 12B and to prevent the pig from being fortuitously entrapped in the first branch of pipe 12A.

For the passage of a "rigid" pig the connection of the upstream and downstream undersea flow pipe segments 1A and 1B with the upstream and downstream connections 15 and 16, respectively, of the device for the passage of a rigid pig, must provide a smooth path without sharp edges so as to preclude the rigid pig from being clogged in said connections.

By proceeding this way the pig is enabled to easily pass into the device 17 for the passage of a rigid pig, thereby precluding it from passing into a curved pipe branch as it did in the previous embodiment.

What really occurs in both embodiments depicted in FIGS. 1 and 2 is the connection of a by-pass to the region where a hollow flow constricting device is installed, enabling an operation of by-passing the hollow flow-constricting device to occur when a rigid pig is being passed along the flow pipe 1. Such embodiments are well suited for the situation where an existing undersea flow pipe having a hollow flow-constricting device into it should be adapted to enable rigid pigs to pass into it.

Figure 3:
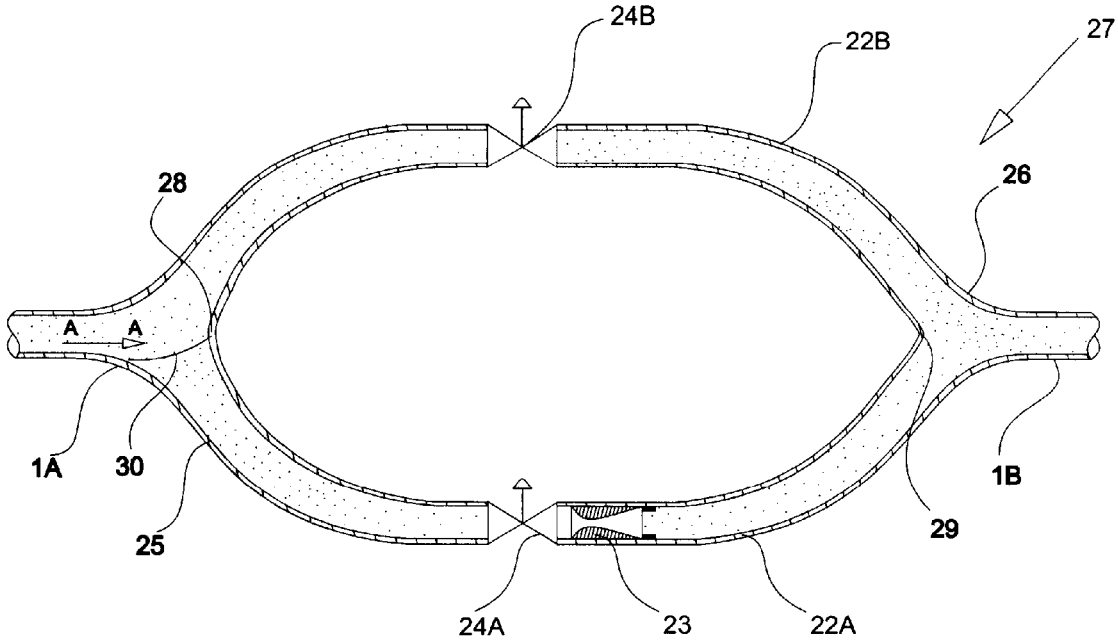
FIG. 3 is a longitudinal cross sectional view depicting an undersea flow pipe connected to a device according to a third embodiment of the present invention.

In FIG. 3 there is depicted a third embodiment of the device for the passage of a rigid pig, indicated by the numeral reference 27, connected to an undersea flow pipe 1. A fluid flow A—A flows into the undersea flow pipe 1, in the direction indicated by the arrow in the FIG. 3.

In FIG. 3 the undersea flow pipe 1 is depicted with its upstream and downstream segments 1A and 1B, respectively, connected to upstream and downstream connections of the device 27 for the passage of a rigid pig, as will be seen below in more detail.

The device 27 for the passage of a rigid pig depicted in the FIG. 3 is connected to upstream and downstream undersea flow pipe segments 1A and 1B at its upstream and downstream connections 25 and 26, respectively, and comprises the following components:

- a first pipe branch 22A, provided with an upstream end and a downstream end;
- a second pipe branch 22B, provided with an upstream end and a downstream end;
- a hollow flow constricting device 23, installed in the first pipe branch 22A;
- a first shut-off valve 24A, installed in the first pipe branch 22A;
- a grating device 30 at the interconnection of the upstream ends of the first pipe branch 22A and the second pipe branch 22B to guide a rigid pig away from the first pipe branch 22A and into the second pipe branch 22B; and
- a clear-flow second shut-off valve 24B, installed in the second pipe branch 22B;

wherein:

- the upstream ends of the first and second pipe branches 22A and 22B are interconnected at an upstream junction 28 which is provided with an upstream connection 25;
- the downstream ends of the first and second pipe branches 22A and 22B are interconnected at a downstream junction 29 which is provided with a downstream connection 26;
- the upstream connection 25 is connected to the upstream undersea flow pipe segment 1A; and
- the downstream connection 26 is connected to the downstream undersea flow pipe segment 1B.

The first and second pipe branches 22A and 22B, respectively, are preferably provided with a cross section which is substantially equal to the cross section of the upstream and downstream undersea flow pipe segments 1A and 1B, respectively. However, the cross section of the first and second pipe branches 22A and 22B can be larger than or smaller than the cross section of the upstream and downstream undersea flow pipe segments 1A and 1B, and they can even be different from each other.

In the embodiment of FIG. 3 the first pipe branch 22A and the second pipe branch 22B are preferably symmetrical to each other and also with respect to the upstream and downstream undersea flow pipe segments 1A and 1B; the upstream and downstream junctions 28 and 29, respectively, are provided with smooth curves, thereby precluding the rigid pig from being clogged in such curves.

The first shut-off valve 24A may be installed in the first pipe branch either upstream or downstream of the hollow flow-constricting device 23. In FIG. 3, merely for purposes of illustration, the first shut-off valve 24A is installed in the first pipe branch upstream of the hollow flow-constricting device 23. The clear-flow second shut-off valve 24B may be installed at any region of the second pipe branch 22B.

In the embodiment of FIG. 3 the first shut-off valve 24A is kept open and the clear-flow second shut-off valve 24B is kept closed under normal operational conditions, whereby the flow A—A is led to pass through the hollow flow-constricting device 23.

When it is necessary to pass a rigid pig into the undersea flow pipe 1 it suffices to open the clear-flow second shut-off valve 24B and to close the first shut-off valve 24A, as will be seen below in more detail, whereby the flow A—A is led to pass only into the second pipe branch 22B.

The grating device 30 acts as a guide to ensure the displacement of the rigid pig, towards the second branch of pipe 22B and to prevent the rigid pig from being fortuitously entrapped in the first pipe branch 22A.

The connection of the upstream and downstream undersea flow pipe segments 1A and 1B with the upstream and downstream connections 25 and 26, respectively, of the device for the passage of a rigid pig must provide a smooth curved path for the passage of the rigid pig, so as to preclude the rigid pig from being clogged in said connections.

The method to allow a rigid pig to pass into a flow pipe in which a hollow flow constricting device is used, and using the device for the passage of a rigid pig, is described in the following. Such method is applicable in connection with any of the previous described embodiments of the devices for the passage of a rigid pig, and for that reason the reference numerals of similar components in the various embodiments are shown in round brackets.

The method to allow a rigid pig to pass into a flow pipe in which a hollow flow-constricting device is in use, and using the device for the passage of a rigid pig, comprises the following steps:

- initially opening the clear-flow shut-off valve (4B, 14B, 24B), which is kept closed under normal operational conditions, whereby the flow is led to pass also into the second pipe branch (2B, 12B, 22B);
- next closing the first shut-off valve (4A, 14A, 24A), which is kept open under normal operational conditions, thereby blocking off the flow from passing into the first pipe branch (2A, 12A, 22A), whereby the flow is led then to pass only into the second pipe branch (2B, 12B, 22B);
- next inserting a rigid pig into a mechanism suited for such operation, located at any region of the upstream undersea flow pipe segment 1A;
- allowing the rigid pig to travel, urged by the flow A—A, along the upstream undersea flow pipe segment 1A, to pass into the upstream connection (5, 15, 25), next to travel along the second pipe branch (2B, 12B, 22B), through the clear-flow second shut-off valve (4B, 14B, 24B), and then into the downstream connection (6, 16, 26) and to keep on travelling along the downstream undersea flow pipe segment 1B;
- then opening the first shut-off valve (4A, 14A, 24A), after the rigid pig has passed the downstream connection (6, 16, 26); and
- next closing the clear-flow second shut-off valve (4B, 14B, 24B), thereby reinstating the normal operational conditions.

The monitoring of the passage of the rigid pig into the second pipe branch (2B, 12B, 22B) may be carried out, for example, by means of a dedicated sensor installed in the second pipe branch specifically for that purpose. Other means known in the art, which are not described here because they are well known by the experts and also because they are not part of the scope of the invention, may also be used to monitor such passage of the rigid pig.

It must be mentioned here that although the present invention has been described with respect to an undersea flow pipe, this is only a particular situation, as the device and the method of the present invention may be used in any situation where there is a need to pass a "rigid" pig into a flow pipe in which a hollow flow-constricting device is used, be such flow pipe in an undersea environment or not.

Further, it should be mentioned that although the devices and the method herein described are intended to be used when it is needed to pass a radially rigid pig into a flow pipe having a hollow flow-constricting device installed in it, they can also be used when a radially flexible rigid pig, e.g. a foam rigid pig, is used, as a way to prevent such a radially flexible pig from being deformed or even destroyed when passing through the hollow flow-constricting device.

It must also be mentioned here that, in the scope of the present invention, a clear-flow shut-off valve is understood as being a shut-off valve which, when totally open, is provided with a cross section which is substantially equal to the cross section of the flow pipe to which the valve is connected.

Moreover, it should be mentioned that the shut-off valves depicted in FIGS. 1, 2 and 3 may be manually or mechanically operated, and either remotely or locally controlled.

Those skilled in the art will immediately notice that modifications can be introduced in the device and in the method disclosed herewith without departing from the scope and the spirit of the present invention.

Having described the present invention with respect to its preferred embodiments, it should be mentioned that the present invention is not limited to the description heretofore made, being only limited by the scope of the appendant claims.

What is claimed is:

1. A device to allow a pig to pass into a flow pipe in which a hollow flow-constricting device is in use, said device comprising:

a first pipe branch, provided with an upstream end and a downstream end;

a second pipe branch, provided with an upstream end and a downstream end;

a hollow flow-constricting device installed in said first pipe branch;

a first shut-off valve, installed in said first pipe branch;

a clear-flow second shut-off valve, installed in said second pipe branch;

a grating device, installed at upstream ends of said first pipe branch and said second pipe branch to prevent a rigid pig from entering said first pipe branch;

wherein:

said upstream ends of said first and second pipe branches are interconnected at an upstream junction which is provided with an upstream connection; and said downstream ends of said first and second pipe branches are interconnected at a downstream junction which is provided with a downstream connection.

2. A device corresponding to claim 1, wherein said upstream connection is connected to an upstream flow pipe segment of said flow pipe; and said downstream connection is connected to a downstream flow pipe segment of said flow pipe.

3. A device according to claim 2, wherein said flow pipe is an undersea flow pipe.

4. A device according to claim 2, wherein said first pipe branch is substantially in alignment with said upstream and downstream flow pipe segments.

5. A device according to claim 3, wherein said first pipe branch is substantially in alignment with said upstream and downstream flow pipe segments.

6. A device according to claim 2, wherein said second pipe branch is substantially in alignment with said upstream and downstream flow pipe segments.

7. A device according to claim 3, wherein said second pipe branch is substantially in alignment with said upstream and downstream flow pipe segments.

8. A device according to claim 2, wherein said first pipe branch and said second pipe branch are symmetrical with respect to each other and also with respect to said upstream and downstream flow pipe segments.

9. A device according to claim 3, wherein said first pipe branch and said second pipe branch are symmetrical with respect to each other and also with respect to said upstream and downstream flow pipe segments.

10. A method of allowing a pig to pass into a flow pipe in which a hollow flow-constricting device is in use, said device comprising:

a first pipe branch, provided with an upstream end and a downstream end;

a second pipe branch, provided with an upstream end and a downstream end;

a hollow flow-constricting device installed in said first pipe branch;

a first shut-off valve, installed in said first pipe branch;

a clear-flow second shut-off valve, installed in said second pipe branch;

a grating device, installed at upstream ends of said first pipe branch and said second pipe branch to prevent a rigid pig from entering said first pipe branch;

wherein:

said upstream ends of said first and second pipe branches are interconnected at an upstream junction which is provided with an upstream connection; and said downstream ends of said first and second pipe branches are interconnected at a downstream junction which is provided with a downstream connection;

said upstream connection is connected to an upstream flow pipe segment of said flow pipe; and said downstream connection is connected to a downstream flow pipe segment of said flow pipe;

wherein a flow of fluids passes along said flow pipe, said method comprising the steps of:

initially opening said clear-flow second shut-off valve, which is kept closed under normal operational conditions, whereby said flow is led to pass also into said second pipe branch;

next closing said first shut-off valve, which is kept open under normal operational conditions, thereby blocking off said flow from passing into said first pipe branch, whereby said flow is led then to pass only into said second pipe branch;

next inserting a pig into a mechanism suited for such operation, located at any region of said upstream flow pipe segment;

allowing said pig to travel along said upstream flow pipe segment, urged by said flow, to pass into said upstream connection, next to travel along said second pipe branch to pass through said clear-flow second shut-off valve, and then to pass into said downstream connection and to keep on traveling along said downstream flow pipe segment;

then opening said first shut-off valve, after said rigid pig has passed the downstream connection; and next closing said clear-flow second shut-off valve, thereby reinstating the normal operational conditions.

11. A method according to claim 10, wherein said flow pipe is an undersea flow pipe.

* * * * *